US005383739A

United States Patent [19]

Haglund

[11] Patent Number: 5,383,739

[45] Date of Patent: Jan. 24, 1995

[54] VARIABLE ANGLE POST FOR COUPLING FENCE SEGMENTS

[76] Inventor: Vernon Haglund, 2029 N. Ocean Blvd., Fort Lauderdale, Fla. 33305

[21] Appl. No.: 76,872

[22] Filed: Jun. 15, 1993

[51] Int. Cl.[6] ..... E04H 17/00

[52] U.S. Cl. ..... 403/107; 403/104; 403/106; 256/65; 256/67

[58] Field of Search ..... 403/83, 84, 103, 104, 403/106, 107; 256/26, 65, 67

[56] References Cited

U.S. PATENT DOCUMENTS

| | | | |
|---|---|---|---|
| 1,772,159 | 8/1930 | Roth | 256/65 |
| 2,976,021 | 3/1961 | Stefan | 256/65 |
| 4,923,176 | 5/1990 | Heinz | 256/65 |
| 4,982,535 | 1/1991 | Pickett | 256/26 |

FOREIGN PATENT DOCUMENTS

| | | | |
|---|---|---|---|
| 8706973 | 11/1987 | WIPO | 256/65 |

*Primary Examiner*—Richard A. Bertsch
*Assistant Examiner*—William J. Wicker
*Attorney, Agent, or Firm*—M. K. Silverman

[57] ABSTRACT

A coupling system for joining articulated fence segments at a desired relative angle.

1 Claim, 2 Drawing Sheets

VARIABLE ANGLE POST FOR COUPLING FENCE SEGMENTS

BACKGROUND OF THE INVENTION

The present invention relates to a coupling system for joining articulated fence segments at a desired relative angle. In the construction and assembly of fence segments it is often necessary to create corners in a given fence in which such corners will occupy a relative angle other than that of ninety degrees. The creation of such non-right angle intersections between fence segments has, in the prior art, required special purpose tooling and assembly such that non-right angle intersections generally called for construction at factory site, as opposed to assembly in the field.

The problem of creating angle intersections or coupling between fence segments is compounded where the fence is made of a metallic material. More particularly, the use of tubular aluminum elements in fence construction has in recent years become more common with the advent of sophisticated prefabrication, assembly and installation methods. However there has been little, if any, advance in the construction of articulated fence segments where the fence is made of a tubular metallic material. It is, therefore, in response to the need for such a coupling system between metal fence segments that the instant invention is directed.

SUMMARY OF THE INVENTION

The present invention pertains to a variable angle post for joining articulated fence segments at a desired angle therebetween. The system, more particularly, includes a stationary part and a rotating part. The stationary part comprises, in transverse horizontal cross-section, a first planar surface having, at a first edge thereof, curved surface engaging means. The stationary part also includes, in horizontal cross-section, a second planar surface integrally depending from a second and opposite edge of said first surface and normal thereto. Said stationary part further includes a third planar surface integrally depending from an edge of said second surface not dependent from said first surface, said third surface normal to said second surface and parallel to said first surface, said third surface having a free edge opposite to its edge of dependency with said second surface in which the distance of said free edge relative to said second surface is defined by a selected breakage of scoring notches, co-parallel with said edges of said other surfaces, on said third surface.

The rotating part of the inventive system comprises, in transverse horizontal cross-section, a first planar surface having, at a first edge thereof, a semi-cylindrical surface complemental to said curved surface engaging means. The rotating part of the system also includes a second planar surface integrally depending from a second and opposite edge of said first surface and normal thereto. The rotating part yet further includes a third planar surface integrally depending from an edge of said second surface not dependent from said first surface, said third surface normally to said second surface and parallel to said first surface, said third surface further having a free end opposite to said surface's edge of dependency with said second surface, said free end having, on an exposed side thereof, a plurality of recesses each having a geometry complemental to said free edge of said third surface of said stationary part resultant from said selected breakage of said scoring notches.

Resultingly a coupling of a selected one of said recesses with said free edge of said stationary part will produce a fixed coupling between said parts at a desired relative angle between first surfaces of the stationary and rotating parts of the inventive system.

It is an object of the above invention to provide a means for joining, at a desired relative angle other than ninety degrees, segments of a fence system.

It is another object of the invention to provide a means by which assembly personnel working in the field can, at a work site, easily construct fence segments made of hollow metallic tubular elements, such segments having a desired articulation relative to each other.

It is a further object to provide a post for use between fence segments that can establish a relative angle between the segments at either side of the post.

The above and yet other objects and advantages of the present invention will become apparent from the hereinafter set forth Brief Description of the Drawings, Detailed Description of the Invention, and claims appended herewith.

DETAILED DESCRIPTION OF THE DRAWINGS

DETAILED DESCRIPTION OF THE INVENTION

Figure 2:
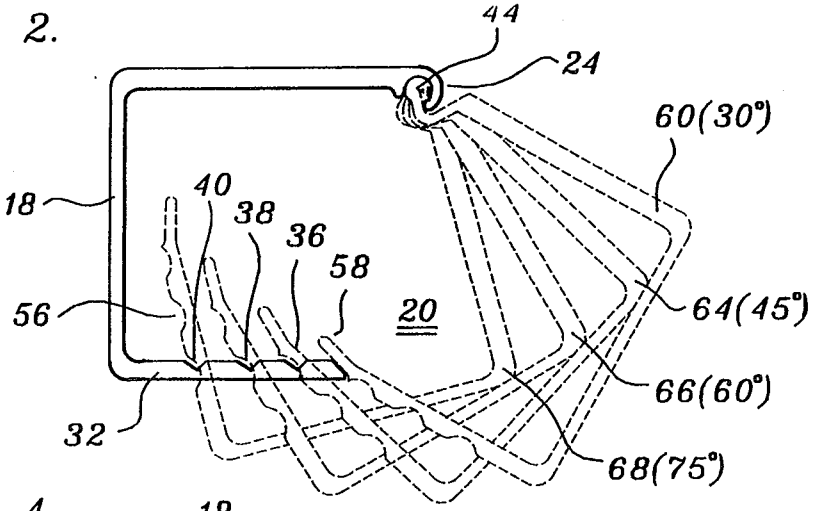
FIG. 2 is a horizontal transverse cross-sectional view of the respective parts of the invention showing various angulations between the parts thereof that may be effected.
Figure 1:
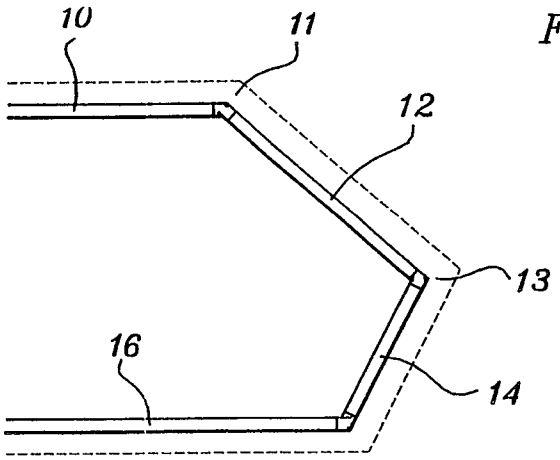
FIG. 1 is a top plan view of a fence system constructed in accordance with the present invention.

With reference to the top view of FIG. 1 there are shown several segments of a fence system of a type that may be constructed in accordance with the present invention. There is, more particularly, shown a fence system consisting of segments 10, 12, 14 and 16. Shown therein are couplings 11 and 13 which are created in accordance with the inventive couplings as is more particularly set forth below. The coupling 13 is shown in enlarged sectional view in FIG. 3 and the coupling 11 is shown in enlarged sectional view in FIG. 4. Shown in FIG. 2 is an operational view of the components of the present system, namely, stationary part 18 and rotating part 20. As may be seen in the views of FIGS. 2 thru 5, said stationary part 18 comprises, in the horizontal sectional views of said figures, a first planar surface 22 having, at a free edge 23 thereof curved surface rotational engaging means 24. As may be noted, said engaging means 24 is a solid longitudinal channel having the cross-sectional geometry of a semicircle.

At opposite edge 26 of said first planar surface 22 a second planar surface 28 depends normally to said surface 22. Integrally depending from an edge 30 of said second surface 28 is third planar surface 32. As may be noted in the views of FIGS. 2 thru 5, said third surface 32 is normal to said second surface 28 and is substantially parallel to said first surface 22. As may be further noted in the figures said third surface exhibits a free edge 34 in which the distance of the edge 34 relative to said second surface 28 is defined by a plurality of scoring notches 36, 38 and 40 all of which are longitudinal grooves that are co-parallel with said edges 26 and 30 of the stationary part 18. As is further set forth below, each of said scoring notches corresponds to a possible angulation between the major axes of parts 18 and 20 that will result from assembly of said parts of the inventive coupling system.

With reference to said rotating part 20 of the coupling system, said part may, with reference to FIGS. 2 thru 5, be seen to include, in horizontal transverse cross-section, a first planar surface 42 having, at a free edge thereof, a solid semi-circualar surface 44 which is complemental in geometry to said engaging means 24 of first surface 22 of stationary element 18. As may be noted in the enlarged view of FIG. 6, semi-cylindrical element 44 is proportioned for rotational engagement within semi-circular means 24 of the stationary part 18. See also FIG. 2. It is to be appreciated that while the embodiment shown herein employs a thin neck 46 having a total included angle of about sixty degrees, between surface 42 and semi-circular surface 44, it is to be appreciated that various geometries may be used in lieu thereof, so long as a slidable rotational hinge-like relationship between surface 44 and receiving means 24 can be maintained for movement in the fashion shown in FIGS. 2 thru 4.

Integrally depending from edge 48 of first surface 42 of the rotating part 20 is a second planar surface 50 which, as may be noted, is normal to said first surface 42.

Figure 4:
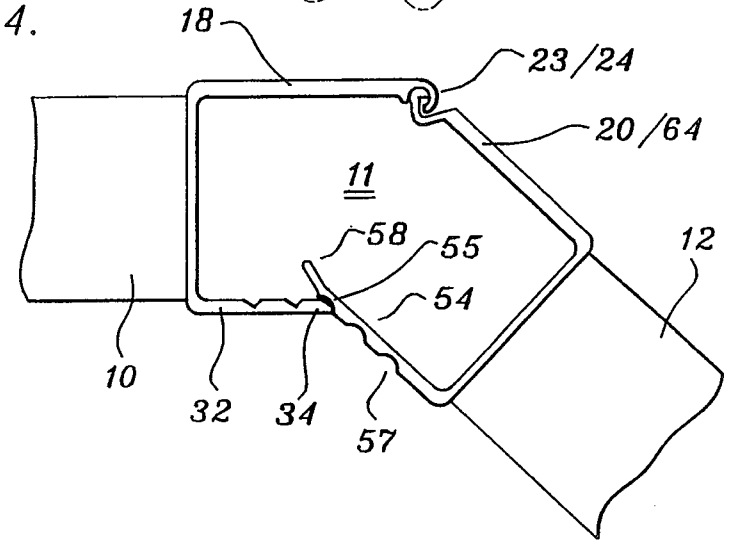
FIG. 4 is a view, similar to the view of FIG. 3, showing a different angulation between fence segments that can be accomplished with the present invention.
Figure 3:
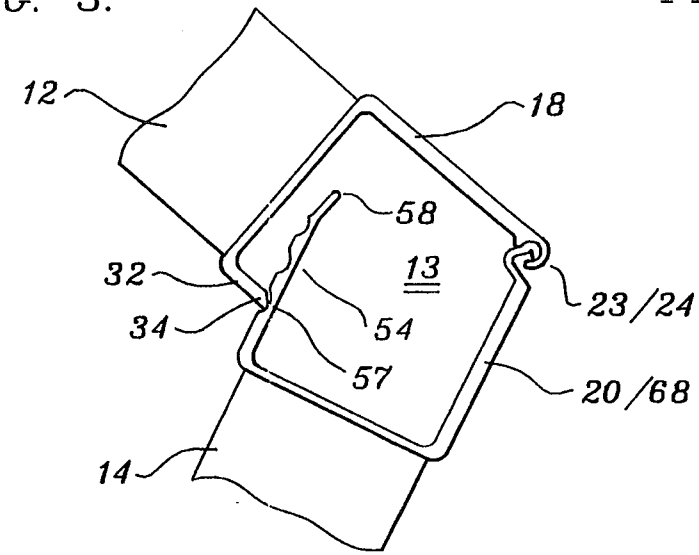
FIG. 3 is a view, similar to one of the angulations shown in FIG. 2, showing a resultant coupling between fence segments.

Integrally depending from edge 52 of said second surface 50 is third planar surface 54 of the rotating part 20. Said third surface 54 is normal to said second surface 50 and is co-parallel with said first surface 42. Further the third planer surface 54 is provided with a plurality of recesses 55, 56 and 57 which are substantially complemental in geometry to the geometry of free end 34 of stationary part 18. Said third surface 54 of the rotating part 20 is further provided with an integral element 58 which, as may be noted in the views of FIGS. 2 thru 4, is bent upwardly after the coupling of stationary part 18 to rotating part 20.

In operation, one of the notches 36, 38 or 40 of said third surface of said stationary part will be selected for breakage such that one of the relative angles between stationary and rotating parts shown in FIG. 2 may be formed by the inventive structure. For example, if a thirty degree angle relative to the parts is desired, integral element 58 will rest upon edge 34 without the breakage of any of the scoring notches 36 thru 38 this corresponding to the outermost position that us, phantom view 60 in FIG. 2.

If one wishes to achieve a forty-five degree angle between parts 18 and 20, segment 62 of third surface 32 is broken-off by cutting and then twisting, along score notch 36. See FIG. 5. This will permit the first recess 55 to rest against the newly created free edge of third surface 32 in the manner shown in phantom view 64 of FIG. 2. That is, in said view, rotating part 20 has rotated within the joint created by said elements 24 and 44 such that the first recess 55 will mate with the newly created free edge of third surface 34 part 18. This position is shown in phantom in FIG. 2 and in solid lines in FIG. 4.

Where an angle of sixty degrees is desired, the position shown in phantom view 66 of FIG. 2 is employed. Therein, third surface 32 of the stationary part has been broken at second notch 38 such that second recess 56 may mate with the new edge 34 created by the breaking-off of segment 67 of surface 32.

Where a relative angle of seventy-five degrees is desired between parts 18 and 20 (and corresponding fence segments 12 and 14), said third surface 32 of stationary part 18 is broken at third notch 40, eliminating segment 69, such that third recess of recess 57 will engage new edge 34 in the manner shown in phantom view 68 in FIG. 2 and in solid lines in FIG. 3.

Figure 5:
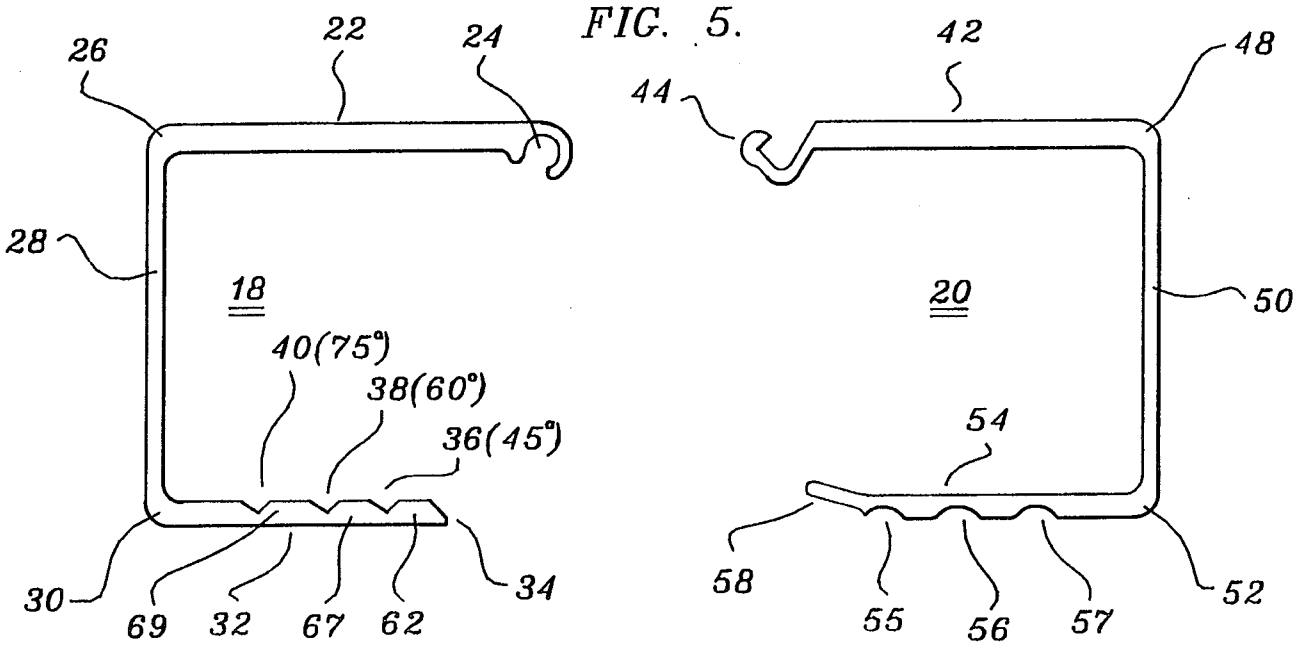
FIG. 5 is an exploded view showing the respective parts of the inventive system.
Figure 6:
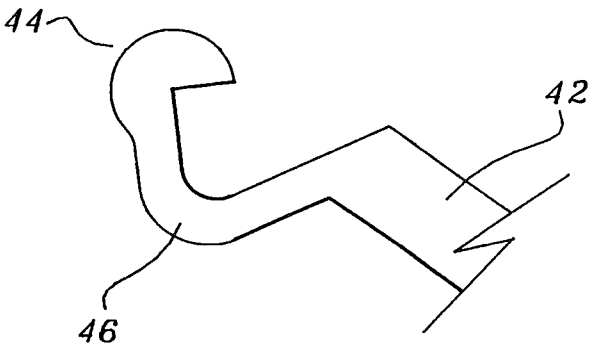
FIG. 6 is an enlarged view of the solid semi-circular surface of the rotating part of the system.

There is accordingly provided a system by which the pieces of hardware shown in FIG. 5 may be utilized to form intersections of the type shown in FIG. 1 between any segment of any type of fence that can be interfaced with stationary part 18 and rotating part 20. Such interfacing will be most easily accomplished where the second surfaces 28 and 50 of the respective parts may be press-fit into a square or rectangular cross-sectioned tubular element from which sections 10, 12, 14 and 16 of the fence shown in FIG. 1 are made. However, it is to be appreciated that, with minimal additional effort, interfacing with fence segments of other types may be readily accomplished.

While there has been shown and described the preferred embodiment of the present invention, it is to be understood the invention may be embodied otherwise than is herein specifically shown and described and that within such embodiment certain changes may be made without departing from the underlying principles or ideas of this invention within the scope of the claims appended herewith.

Having thus described my invention what I claim as new, useful and non-obvious and, accordingly, secure by Letters Patent of the United States is:

1. A coupling system for joining articulated fence segments at a desired relative angle, the system comprising:

(a) a stationary part comprising, in transverse horizontal cross-section (i) a first planar surface having, at a first edge thereof, curved surface rotational engaging means, (ii) a second planar surface integrally depending from a second and opposite edge of said first surface and normal thereto, and (iii) a third planar surface integrally depending from an edge of said second surface not dependent from said first surface, said third surface normal to said second surface and parallel to said first surface, said third surface further having a free edge opposite to its edge of dependency with said second surface, in which the distance of said free edge relative to said second edge is defined by the selected breakage of scoring notches, co-linear with said edges of said surfaces, within said third surface; and (b) a rotating part comprising, in transverse horizontal cross-section (i) a first planar surface having, at a first edge thereof, a solid semi-circular solid surface complemental in geometry to said curved surface engaging means of said stationary part, (ii) a second planar surface integrally depending from a second and opposite edge of said first surface and normal thereto, and (iii) a third planar surface integrally depending from an edge of said second surface not depending from said first surface, said third surface normal to said second surface and parallel to said first surface, said third surface further having a free edge portion thereof opposite to its edge of dependency with said second surface, having, on an exposed side thereof, a plurality of recesses each having a geometry complemental to said free edge of said third surface of said stationary part resulting from said selected breakage of said scoring notches of said third surface of said stationary part, whereby coupling of a selected one of said recesses with said resulting free edge of said third surface of said stationary part will produce a fixed coupling between said parts at a desired angle between said first surfaces of both of said parts.

* * * * *